US006027331A

United States Patent [19]

Döbbeling et al.

[11] Patent Number: 6,027,331

[45] Date of Patent: Feb. 22, 2000

[54] BURNER FOR OPERATING A HEAT GENERATOR

[75] Inventors: Klaus Döbbeling, Windisch; Hans Peter Knöpfel, Besenbüren; Thomas Ruck, Mellingen, all of Switzerland

[73] Assignee: ABB Research Ltd., Zurich, Switzerland

[21] Appl. No.: 09/187,343

[22] Filed: Nov. 6, 1998

[30] Foreign Application Priority Data

Nov. 13, 1997 [EP] European Pat. Off. ..... 97810867

[51] Int. Cl.[7] ..... F23D 14/02

[52] U.S. Cl. ..... 431/182; 431/354

[58] Field of Search ..... 431/354, 350, 431/9, 182, 181, 185; 239/399, 427.3, 402, 434, 466

[56] References Cited

U.S. PATENT DOCUMENTS

| | | | |
|---|---|---|---|
| 4,701,124 | 10/1987 | Maghon et al. | 431/284 |
| 5,062,792 | 11/1991 | Maghon | 431/284 |
| 5,735,687 | 4/1998 | Knöpfel et al. | 431/354 |
| 5,876,196 | 3/1999 | Knöpfel et al. | 431/354 |

FOREIGN PATENT DOCUMENTS

| | | |
|---|---|---|
| 0321809B1 | 5/1991 | European Pat. Off. . |
| 0747635A2 | 12/1996 | European Pat. Off. . |
| 0780629A2 | 6/1997 | European Pat. Off. . |
| 2508665 | 9/1976 | Germany . |
| 19545310A1 | 6/1997 | Germany . |
| WO93/17279 | 9/1993 | WIPO . |

*Primary Examiner*—Ira S. Lazarus
*Assistant Examiner*—Sara Clarke
*Attorney, Agent, or Firm*—Burns, Doane, Swecker & Mathis, L.L.P.

[57] ABSTRACT

In a burner for operating a combustion chamber, which burner essentially comprises a swirl generator (100), a transition piece (200) arranged downstream of the swirl generator, and a mixing tube (20), transition piece (200) and mixing tube (20) forming the mixing section of the burner and being arranged upstream of a combustion space (30). The swirl generator (100) itself comprises at least two hollow, conical sectional bodies (140, 141, 142, 143) which are nested one inside the other in the direction of flow, the respective center axes of these sectional bodies running mutually offset in such a way that the adjacent walls of the sectional bodies form inlet ducts (120), tangential in their longitudinal extent, for a combustion-air flow (115). In the region where the combustion-air flow (115) flows into the swirl generator (100), fuel injectors (116, 116*a*) are arranged on both sides along the inflow edges, which fuel injectors act offset with respect to one another, in such a way that the inflow cross section of the duct (120) is integrally covered with fuel, with the result that a maximized premixing is achieved.

11 Claims, 4 Drawing Sheets

103

100
116
116a
115
201
200
10
220
40
21
20
60
31

50
30

BURNER FOR OPERATING A HEAT GENERATOR

BACKGROUND OF THE INVENTION

1. Field of the Invention

The present invention relates to a burner for operating a heat generator.

2. Discussion of Background

EP-0 780 629 A2 has disclosed a burner which consists of a swirl generator on the incident-flow side, the flow formed herein being passed over smoothly into a mixing section. This is done with the aid of a flow geometry, which is formed at the start of the mixing section for this purpose and consists of transition passages which cover sectors of the end face of the mixing section, in accordance with the number of acting sectional bodies of the swirl generator, and run helically in the direction of flow. On the outflow side of these transition passages, the mixing section has a number of prefilming bores, which ensure that the flow velocity along the tube wall is increased. This is then followed by a combustion chamber, the transition between the mixing section and the combustion chamber being formed by a jump in cross section, in the plane of which a backflow zone or backflow bubble forms. The swirl intensity in the swirl generator is therefore selected in such a way that the breakdown of the vortex does not take place inside the mixing section but further downstream, as explained above, in the region of the jump in cross section.

Although this burner, compared with those from the prior art, guarantees a significant improvement with regard to intensification of the flame stability, lower pollutant emissions, lower pulsations, complete burn-out, large operating range, good cross-ignition between the various burners, compact type of construction, improved mixing, etc., it has been found that the increasing demands placed on burner technology may give rise to problems with regard to adequate premixing between the fuel and the combustion air, with the result that the pollutant emissions cannot always be minimized to the desired extent. In this respect, in order to counteract this, it would be necessary for the distance between the fuel injection location and the flame front to be very long, which in the case of a burner for operating a heat generator is not possible for spatial reasons and operating considerations.

SUMMARY OF THE INVENTION

Accordingly, one object of the invention, as in a burner of the aforementioned type mentioned at the beginning, is to propose novel measures which are able to improve the mixing quality of the fuel/air mixture.

To achieve this object, the fuel is injected in the swirl generator on both sides along the inlet ducts through which the combustion air flows into the interior.

The essential advantages of the invention may be seen in the fact that, owing to the injection of fuel provided on both sides of the inlet ducts, an improved depth of penetration of the fuel into the combustion flow is achieved, leading to improved premixing between fuel and combustion air.

Furthermore, according to the invention it is provided for the injection levels of the two fuel-injector rows which are arranged at the transition to the interior of the swirl generator to increase from the tip toward the outlet of the swirl generator. As a result, the section covered before the fuel injectors situated further downstream enter the swirl generator, is increased, leading to better premixing of the injected fuel.

The subject matter of the invention is also especially suitable for use in the case of other burners in which the swirl generator at the same time forms the premixing section of the burner. In particular, in this connection, reference is made to publication EP-0 321 809 B1, which is an integral part of the present description.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 5:
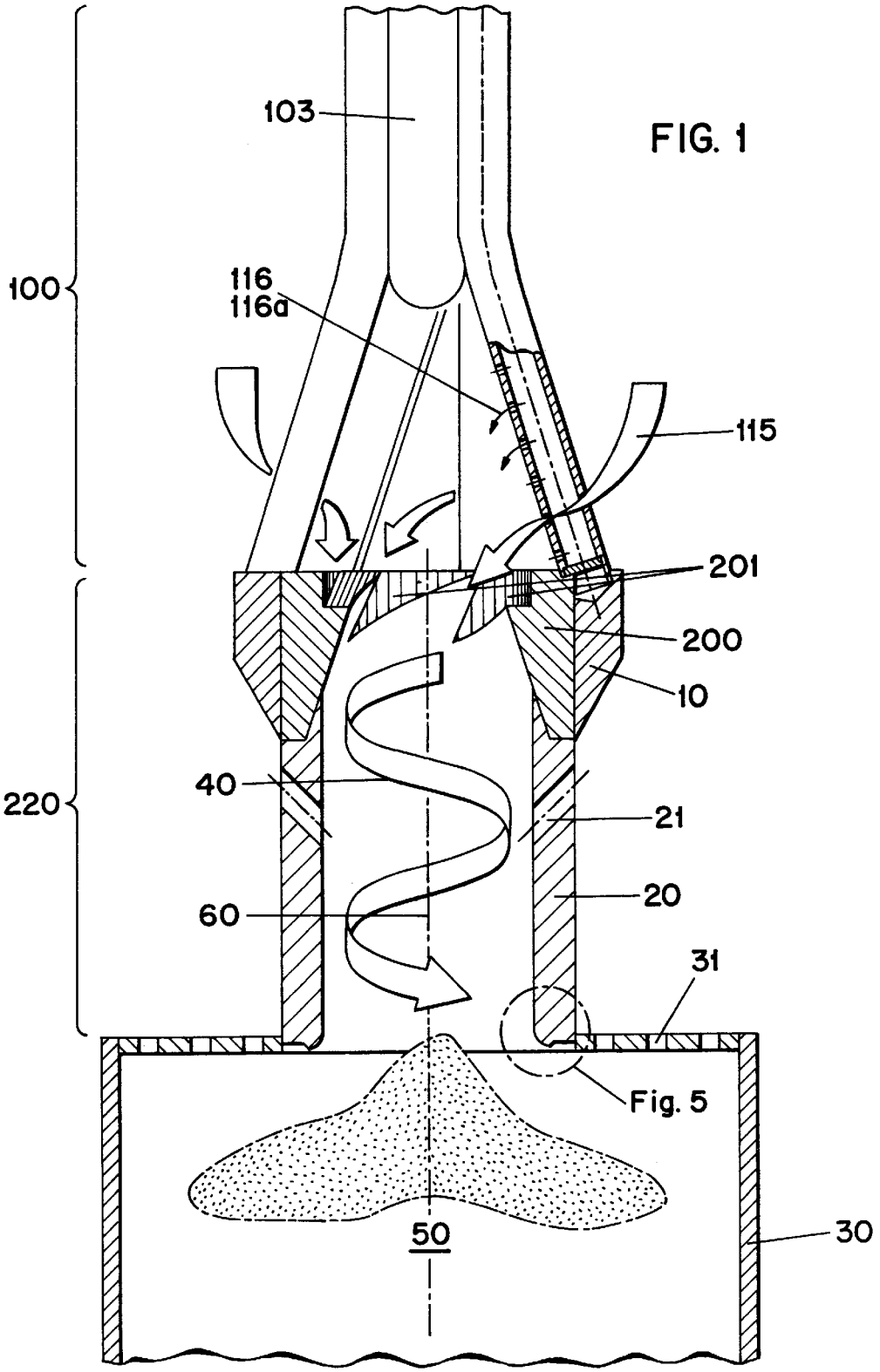
FIG. 1 shows a burner designed as a premix burner and having a mixing section downstream of a swirl generator.
FIG. 5 shows a breakaway edge for the spatial stabilization of the backflow zone.

Referring now to the drawings, wherein like reference numerals designate identical or corresponding parts throughout the several views, all features not essential for the direct understanding of the invention have been omitted, and the direction of flow of the media is indicated by arrows, FIG. 1 shows the overall construction of a burner. At the head of the burner, a swirl generator 100 is effective, the configuration of which is shown and described in more detail below in FIGS. 2 and 3. This swirl generator 100 is a conical body to which an entering combustion-air flow 115 is repeatedly admitted tangentially in the circumferential direction, various injections 116, 116*a* for a gaseous and/or liquid fuel being disposed in the region where this combustion air 115 flows in: in this respect, reference is made to the statements made under FIGS. 2 and 3. Further injection of fuel can be effected through a fuel nozzle 103 which is arranged centrally and at the head side. Here too, it is possible to operate using a liquid and/or gaseous fuel. The swirl flow forming here, with the aid of a transition geometry provided downstream of the swirl generator 100, is passed smoothly into a transition piece 200, in such a way that no separation regions can form in this zone. The configuration of this transition geometry is described in more detail under FIG. 4. On the outflow side of this transition piece 200, the transition geometry being formed thereby is extended by a mixing tube 20, both parts forming the actual mixing section 220 of the burner. The mixing section 220 may of course be made in one piece; i.e. the transition piece 200 and mixing tube 20 are then fused to form a single cohesive body, the characteristics of each part being retained. If transition piece 200 and mixing tube 20 are made from two parts, these parts are connected by a sleeve ring 10, the same sleeve ring 10 serving as an anchoring surface for the swirl generator 100 on the head side. In addition, such a sleeve ring 10 has the advantage that various mixing tubes can be used without having to change the basic configuration of the burner in any way. Located on the outflow side of the mixing tube 20 is the actual combustion space 30 of a combustion chamber, which is shown here merely by a flame tube. The mixing section 220 largely fulfills the task of providing a defined section, in which perfect premixing of fuels of various types can be achieved, downstream of the swirl generator 100. Furthermore, this mixing section, that is primarily the mixing tube 20, enables the flow to be directed free of losses so that at first no backflow zone or backflow bubble can form even in interaction with the transition geometry, whereby the mixing quality for all types of fuel can be influenced over the length of the mixing section 220. However, this mixing section 220 has another property, which consists in the fact that, in the mixing section 220 itself, the axial velocity profile has a pronounced maximum on the axis, so that a flashback of the flame from the combustion chamber is not possible. However, it is correct to say that this axial velocity decreases toward the wall in such a configuration. In order also to prevent flashback in this region, the mixing tube 20 is provided in the flow and peripheral directions with a number of regularly or irregularly distributed bores 21 having widely differing cross sections and directions, through which an air quantity flows into the interior of the mixing tube 20 and induces an increase in the rate of flow along the wall for the purposes of a prefilmer. These bores 21 may also be designed in such a way that effusion cooling appears at least in addition at the inner wall of the mixing tube 20. Another possibility of increasing the velocity of the mixture inside the mixing tube 20 is for the cross section of flow of the mixing tube 20 on the outflow side of the transition passages 201, which form the transition geometry already mentioned, to undergo a convergence, as a result of which the entire velocity level inside the mixing tube 20 is raised. In the figure, these bores 21 run at an acute angle relative to the burner axis 60. Furthermore, the outlet of the transition passages 201 corresponds to the narrowest cross section of flow of the mixing tube 20. Said transition passages 201 accordingly bridge the respective difference in cross section without at the same time adversely affecting the flow formed. If the measure selected initiates an intolerable pressure loss when directing the tube flow 40 along the mixing tube 20, this may be remedied by a diffuser (not shown in the figure) being provided at the end of this mixing tube. A combustion chamber (combustion space 30) then adjoins the end of the mixing tube 20, there being a jump in cross section, formed by a burner front, between the two cross sections of flow. Not until here does a central flame front having a backflow zone 50 form, which backflow zone 50 has the properties of a bodiless flame retention baffle relative to the flame front. If a fluidic marginal zone, in which vortex separations arise due to the vacuum prevailing there, forms inside this jump in cross section during operation, this leads to intensified ring stabilization of the backflow zone 50. At the end face, the combustion space 30, provided this location is not covered by other measures, for example by pilot burners, has a number of openings 31 through which an air quantity flows directly into the jump in cross section and there, inter alia, helps to intensify the ring stabilization of the backflow zone 50. In addition, it must not be left unmentioned that the generation of a stable backflow zone 50 requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the configuration of the burner front 70 at the end of the mixing tube 20 for stabilizing the backflow zone or backflow bubble 50 is concerned, reference is made to the description under FIG. 5.

Figure 2:
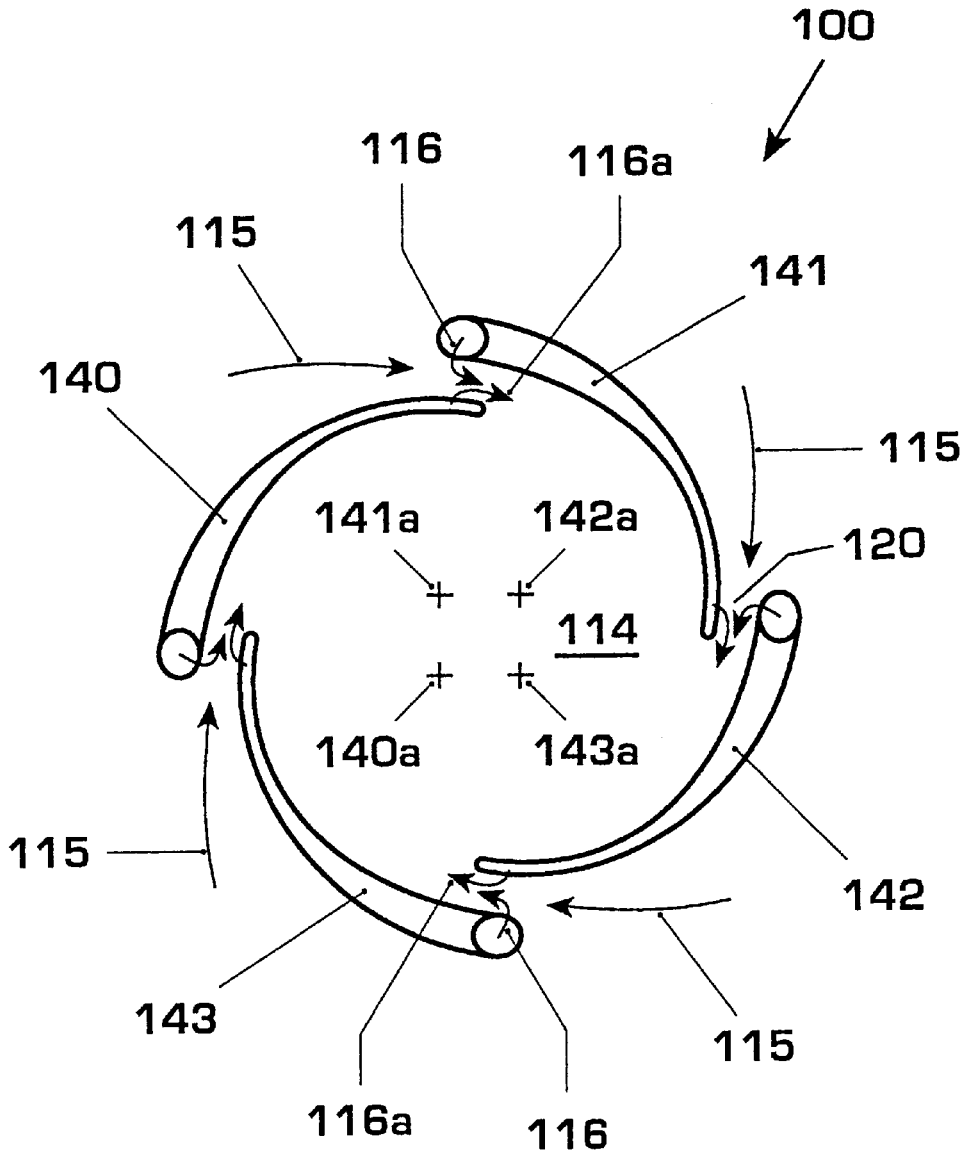
FIG. 2 shows a schematic cross section through a four-shell swirl generator.

FIG. 2 shows a swirl generator 100, which is composed of four sectional bodies 140, 141, 142, 143, these sectional bodies having a blade profile, thus bringing about controlled flow for the combustion-air flow 115 flowing into the interior 114 through the respective inlet ducts 120. The cross section of flow of the inlet ducts 120 is achieved by offsetting the respective center axes 141*a*, 142*a*, 143*a*, 144*a* of the sectional bodies, as emerges particularly clearly from FIG. 2. The fuel 116, 116*a* is injected in the swirl generator on both sides along the inlet ducts 120. A more detailed description of the type of injection emerges from the statements made under FIG. 3.

Figure 3:
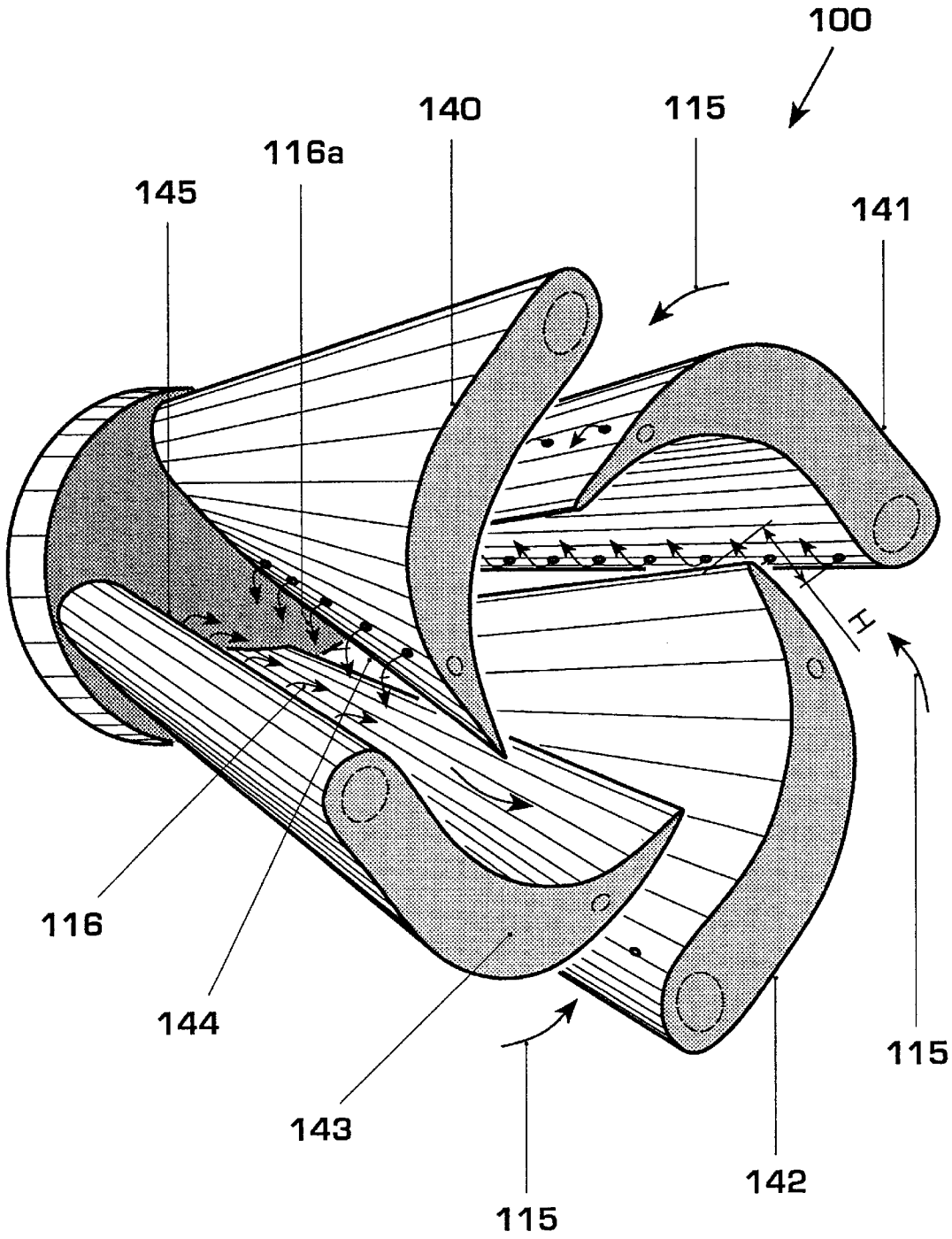
FIG. 3 shows a four-shell swirl generator in three-dimensional view.

FIG. 3 shows a perspective view of a four-slot swirl generator 100. The fuel 116, 116*a* for mixing into the combustion-air flow 115 is in this case guided in by means of fuel lines which are integrated in the sectional bodies 140–143, in contrast to the fuel supply in accordance with EP0 780 629 A2. The introduction of fuel along the inlet ducts 120 on both sides is in this case designed in such a way that the individual injections lying opposite one another are arranged axially offset with respect to one another. As a result, the intermediate space between two injections on one side is filled by the opposite, offset injection on the other side. This is important since, as a result, the injected fuel, which is caught by the combustion-air flow 115, forms a spray in the form of bubbles. Fuel bubbles which form on opposite sides and offset from one another make it possible to fill the entire cross section of the inlet ducts 120, and the depth of penetration of the fuel fed in is greater, which has a positive effect on the formation of the fuel/combustion air mixture. A further measure for optimally configuring the formation of the mixture relates to the configuration of the injection level H of the fuel 116, 116*a* in the axial direction of the swirl generator 100. This increases from the tip of the swirl generator 100 toward the swirl generator outlet. As a result, the relative premixing section for the fuel injections which are situated further downstream of the swirl generator tip is increased, leading to the remixing process becoming more intensive. The described change caused by the geometric profile 144, 145 of the injection levels in the axial direction can be seen from this figure. Naturally, the swirl generator may otherwise be designed in accordance with EP0 780 629 A2, this document forming an integral part of the present description. Swirl generators having a different number of inlet ducts 120 are also possible.

Figure 4:
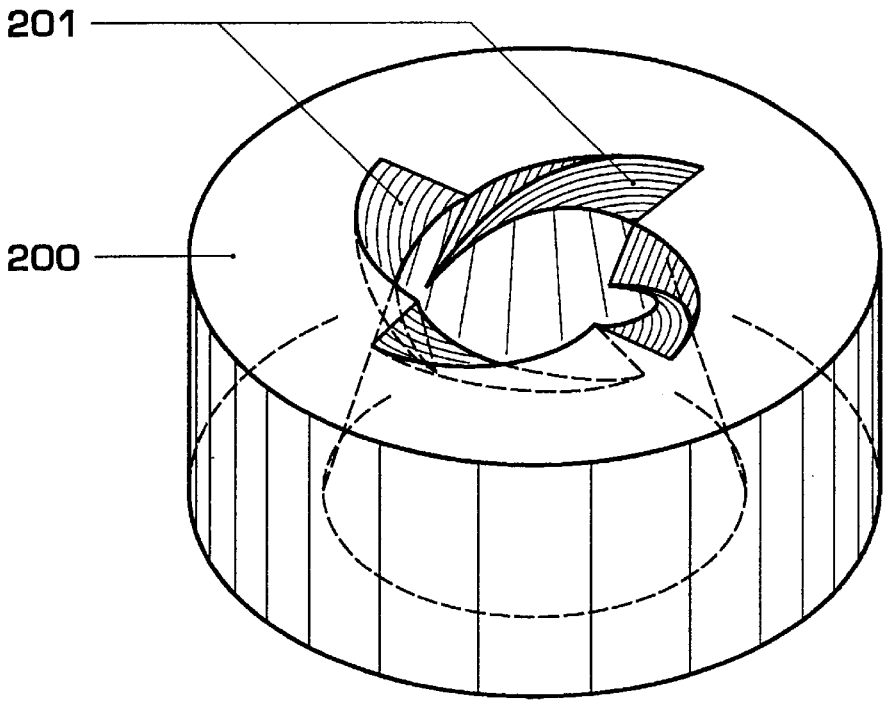
FIG. 4 shows a configuration of the transition geometry between swirl generator and mixing section.
Figure 5:
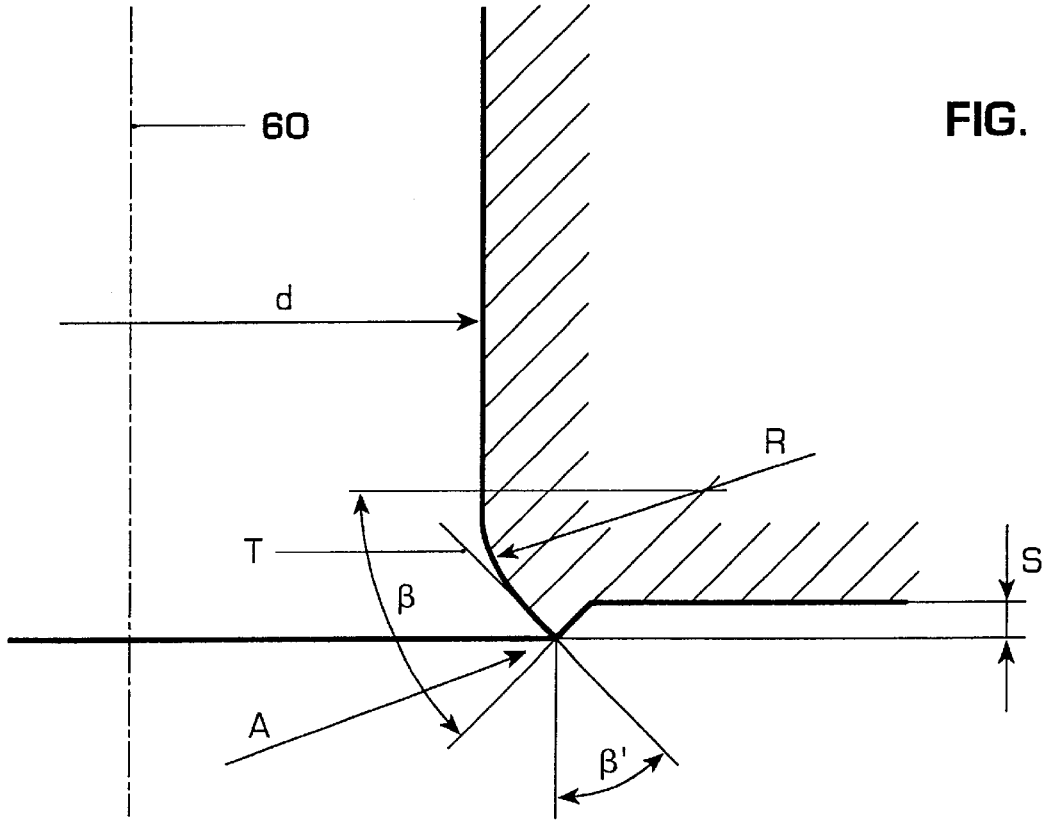

FIG. 4 shows the transition piece 200 in a three-dimensional view. The transition geometry is constructed for a swirl generator 100 having four sectional bodies in accordance with FIGS. 2 and 3. Accordingly, the transition geometry has four transition passages 201 as a natural extension of the sectional bodies acting upstream, as a result of which the cone quadrant of said sectional bodies is extended until it intersects the wall of the mixing tube. The same considerations also apply when the swirl generator is constructed from a principle other than that described under FIG. 3. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile toward the center of the mixing tube, so that the risk of premature ignition is decisively counteracted.

FIG. 5 shows the breakaway edge already discussed, which is formed at the burner outlet. The cross section of flow of the tube 20 in this region is given a transition radius R, the size of which in principle depends on the flow inside the tube 20. This radius R is selected in such a way that the flow comes into contact with the wall and thus causes the swirl coefficient to increase considerably. Quantitatively, the size of the radius R can be defined in such a way that it is >10% of the inside diameter d of the tube 20. Compared with a flow without a radius, the backflow bubble 50 is now hugely enlarged. This radius R runs up to the outlet plane of the tube 20, the angle β between the start and end of the curvature being <90°. The breakaway edge A runs along one leg of the angle β into the interior of the tube 20 and thus forms a breakaway step S relative to the front point of the breakaway edge A, the depth of which is >3 mm. Of course, the edge running parallel here to the outlet plane of the tube 20 can be brought back to the outlet-plane step again by means of a curved path. The angle β' which extends between the tangent of the breakaway edge A and the perpendicular to the outlet plane of the tube 20 is the same size as angle β. The advantages of this design of this breakaway edge can be seen from EP-0 780 629 A2 under the section "SUMMARY OF THE INVENTION". A further configuration of the breakaway edge for the same purpose can be achieved with torus-like notches on the combustion-chamber side. As far as the breakaway edge is concerned, this publication, including the scope of protection there, is an integral part of the present description.

Obviously, numerous modifications and variations of the present invention are possible in light of the above teachings. It is therefore to be understood that, within the scope of the appended claims, the invention may be practiced otherwise than as specifically described herein.

What is claimed is:

1. A burner for operating a heat generator, the burner comprising:

a swirl generator for a combustion-air flow, said swirl generator having an upstream end and a downstream end, a direction of flow extending from said upstream end toward said downstream end along a burner axis, and a plurality of swirl generating inlet ducts each having two sides;

means for injecting at least one fuel into the combustion-air flow;

a mixing section arranged downstream of the swirl generator, said mixing section including transition passages for passing downstream a flow formed in the swirl generator;

a mixing tube arranged downstream of the transition passages, the flow from the transition passages passing into the mixing tube;

wherein the injecting means comprises a fuel injector row on each side of each swirl-generating inlet duct;

wherein each of the two rows of fuel injectors forms an injection level which increases from the tip to the outlet of the swirl generator.

2. The burner in accordance with claim 1, wherein the fuel injectors for each swirl-generating inlet duct are arranged offset in the direction of flow with respect to one another.

3. The burner in accordance with claim 1, wherein the swirl generator comprises at least two hollow, conical sectional bodies which are nested one inside the other in the direction of flow, each sectional body having walls and a center axis, wherein the respective center axes of the sectional bodies are mutually offset in such a way that adjacent walls of the sectional bodies form the swirl-generating inlet ducts for the combustion-air flow, and wherein the sectional bodies together form a premixing section in the interior space formed between the sectional bodies.

4. The burner in accordance with claim 3, further comprising a fuel nozzle arranged at the upstream end of the swirl generator.

5. The burner in accordance with claim 3, wherein each of the sectional bodies have a blade-shaped profile in cross section.

6. The burner in accordance with claim 3, wherein the sectional bodies are nested spirally one inside the other.

7. The burner in accordance with claim 1, wherein the swirl generating inlet ducts each form a partial flow when fluid flows therethrough, and wherein the number of transition passages in the mixing section corresponds to the number of partial flows formed by the swirl generator.

8. The burner in accordance with claim 1, wherein the mixing tube comprises openings extending at least partially in the direction of flow for injecting an air flow into the interior of the mixing tube (20).

9. The burner in accordance with claim 8, wherein the openings extend at an acute angle relative to the burner axis.

10. The burner in accordance with claim 1, further comprising a combustion space having a cross sectional dimension arranged downstream of the mixing section, the mixing section having a cross sectional dimension different from the combustion space cross sectional dimension, wherein the difference in cross section between the mixing section and the combustion space permits a backflow zone to form in the combustion space.

11. The burner in accordance with claim 1, wherein the mixing tube has a downstream end and a breakaway edge on the downstream end.

* * * * *